US010370914B2

(12) United States Patent
Angstmann et al.

(10) Patent No.: US 10,370,914 B2
(45) Date of Patent: Aug. 6, 2019

(54) CHOKE AND KILL SYSTEM

(71) Applicant: Kinetic Pressure Control, Ltd., Houston, TX (US)

(72) Inventors: Steven Anthony Angstmann, Houston, TX (US); Bobby James Gallagher, Houston, TX (US)

(73) Assignee: KINETIC PRESSURE CONTROL LIMITED, City of Lewes, DE (US)

( * ) Notice: Subject to any disclaimer, the term of this patent is extended or adjusted under 35 U.S.C. 154(b) by 0 days.

(21) Appl. No.: 15/712,766

(22) Filed: Sep. 22, 2017

(65) Prior Publication Data

US 2018/0010405 A1 Jan. 11, 2018

Related U.S. Application Data

(63) Continuation of application No. PCT/AU2016/050309, filed on Apr. 29, 2016.

(60) Provisional application No. 62/155,985, filed on May 1, 2015.

(51) Int. Cl.

| | |
|---|---|
| ***E21B 21/08*** | (2006.01) |
| ***E21B 33/038*** | (2006.01) |
| ***E21B 33/035*** | (2006.01) |

(52) U.S. Cl.

CPC ..... *E21B 21/08* (2013.01); *E21B 33/035* (2013.01); *E21B 33/038* (2013.01); *E21B 33/0355* (2013.01)

(58) Field of Classification Search

CPC ..... E21B 21/08; E21B 33/0355

See application file for complete search history.

(56) References Cited

U.S. PATENT DOCUMENTS 4,046,191 A * 9/1977 Neath ..... E21B 21/001 166/352
4,291,772 A * 9/1981 Beynet ..... E21B 21/08 175/25
4,524,832 A * 6/1985 Roche ..... E21B 21/001 166/347

(Continued)

FOREIGN PATENT DOCUMENTS

| | | |
|---|---|---|
| WO | 2003023181 A1 | 3/2003 |
| WO | 2008045381 A2 | 4/2008 |
| WO | 2013138092 A2 | 9/2013 |

OTHER PUBLICATIONS

Written Opinion of the International Search Authority, International Application No. PCT/AU2016/050309, dated Jun. 26, 2016.

(Continued)

*Primary Examiner* — Matthew R Buck
*Assistant Examiner* — Aaron L Lembo
(74) *Attorney, Agent, or Firm* — Richard A. Fagin

(57) ABSTRACT

A choke and kill system, and a method of adapting a low pressure drilling rig for use in a high pressure application are described. The system has a low pressure stack and a high pressure blowout preventer stack fluidly connected to the low pressure stack. A choke is fluidly connected to a low pressure choke line of the low pressure stack and is connected to a high pressure choke line of the high pressure blowout preventer stack. The choke is adapted to reduce the pressure from the high pressure choke line to the low pressure choke line.

34 Claims, 2 Drawing Sheets

(56) References Cited

U.S. PATENT DOCUMENTS 4,813,495 A * 3/1989 Leach ..... E21B 7/12 166/358
5,785,121 A * 7/1998 Dallas ..... E21B 33/03 137/375
5,848,656 A 12/1998 Moksvold
7,062,960 B2 * 6/2006 Couren ..... E21B 33/061 73/152.51
7,163,054 B2 * 1/2007 Adams ..... E21B 17/085 166/242.6
7,274,989 B2 * 9/2007 Hopper ..... E21B 41/00 166/255.1
7,347,261 B2 * 3/2008 Markel ..... E21B 47/0905 166/255.1
7,921,917 B2 * 4/2011 Kotrla ..... E21B 33/035 166/339
7,975,770 B2 * 7/2011 Keener ..... E21B 19/002 166/339
8,746,345 B2 * 6/2014 Kotrla ..... E21B 33/064 166/344
8,978,774 B2 * 3/2015 Fossli ..... E21B 21/001 166/347
9,062,517 B2 * 6/2015 Edwards ..... E21B 33/064
9,175,539 B2 * 11/2015 Livesay ..... E21B 33/0355
9,429,010 B2 * 8/2016 Winters ..... E21B 47/06
2003/0000693 A1 * 1/2003 Couren ..... E21B 33/061 166/66
2007/0016378 A1 7/2007 Keener
2012/0067590 A1 * 3/2012 Fossli ..... E21B 21/001 166/367
2012/0227978 A1 * 9/2012 Fossli ..... E21B 21/001 166/363
2013/0311093 A1 * 11/2013 Winters ..... E21B 47/06 702/6
2013/0311097 A1 * 11/2013 Livesay ..... E21B 33/0355 702/11
2014/0034337 A1 * 2/2014 Van Wijk ..... E21B 33/06 166/387
2014/0144703 A1 * 5/2014 Fossli ..... E21B 21/001 175/5
2016/0076306 A1 * 3/2016 Fossli ..... E21B 21/001 166/340
2016/0109874 A1 * 4/2016 Holmes ..... G05B 19/406 700/275
2017/0089163 A1 * 3/2017 Vitou ..... E21B 47/091
2018/0202253 A1 * 7/2018 Stewart ..... E21B 33/0355

OTHER PUBLICATIONS

International Search Report, International Application No. PCT/AU2016/050309, dated Jun. 26, 2016.

* cited by examiner

CHOKE AND KILL SYSTEM

CROSS REFERENCE TO RELATED APPLICATIONS

Continuation of International Application No. PCT/AU2016/050309 filed on Apr. 29, 2016. Priority is claimed from U.S. Provisional Application No. 62/155,985 filed on May 1, 2015.

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable.

BACKGROUND

This disclosure relates to a choke and kill system. In particular, although not exclusively, the disclosure relates to a choke and kill system for a deep-water drilling rig.

Choke and kill systems are used with drilling rigs to control a well. In particular, choke lines are used to control circulation of a well under pressure or subject to pressure fluctuations by diverting some of the flow, and kill lines are used to place a column of heavy fluid into a well bore in order to prevent flow of wellbore fluids.

Deep-water drilling rigs known in the art are installed with a pressure control apparatus known as a "blow out preventer" (BOP) and a choke and kill system rated for pressure up to 15,000 psi.

As efforts to find and prove new hydrocarbon producing reservoirs moves further out to sea and into deeper waters, it may be expected to include hydrocarbon reservoirs that can exert pressures at the BOP of 20,000 psi or more. Thus the rating of current 15,000 psi systems will be exceeded. This has led to BOPs designed for 20,000 psi or more. These recent BOP designs also require a 20,000 psi choke and kill system.

The recent BOP designs rated for 20,00 psi may require the entire drilling vessel and its drilling related systems to be enlarged to have the carrying and lifting capability to handle the extra weight associated with 20,000 psi BOPs and related choke and kill equipment. The costs to replace or enhance capability of the drilling vessel and drilling equipment to enable drilling of deeper reserves can be very large.

SUMMARY

In one form, although it need not be the only or indeed the broadest form, the present disclosure describes a choke and kill system for a deep water drilling rig, the choke and kill system comprising: a low pressure stack of the deep water drilling rig; a high pressure blowout preventer stack of the deep water drilling rig fluidly connected to the low pressure stack; and a choke fluidly connected to a low pressure choke line of the low pressure stack. The choke may be fluidly connected to a high pressure choke line of the high pressure blowout preventer stack. The choke may be adapted to reduce the pressure from the high pressure choke line to the low pressure choke line.

In some embodiments, the choke and kill system further comprises a high pressure kill line fluidly connected to the high pressure blow out preventer stack. Typically the high pressure kill line is adapted to convey fluid to the high pressure blow out preventer stack. In some embodiments the fluid is drilling fluid which may also be referred to as "mud".

In one aspect of the present disclosure, the high pressure kill line may extend to a surface vessel, where a pump is adapted to supply mud to the high pressure kill line.

In some embodiments, the choke and kill system comprises a subsea pump that is adapted to pump mud into the high pressure kill line. In some embodiments, the subsea pump is a high pressure subsea pump. In some embodiments the subsea pump is adapted to receive mud from a low pressure kill line of the drilling riser. In some embodiments, the subsea pump increases the pressure of the mud from the low pressure kill line to the high pressure kill line. In some embodiments the subsea pump may be adapted to receive mud from a low pressure auxiliary line of the drilling riser. In some embodiments, the subsea pump increases the pressure of the mud from the low pressure auxiliary line to the high pressure kill line.

In some embodiments the subsea pump is driven hydraulically. In some embodiments the subsea pump is driven by a hydraulic motor. More preferably, the subsea pump is driven by at least one radial hydraulic piston motor. In some embodiments, hydraulic fluid to drive the subsea pump is supplied by a riser auxiliary line of the drilling riser. In some embodiments, the hydraulic fluid is seawater. More preferably, once the hydraulic fluid has been used to drive the subsea pump, the hydraulic fluid is discharged to the sea.

In some embodiments the subsea pump comprises ceramic bearings. In some embodiments the subsea pump uses seawater for lubrication.

In some embodiments the subsea pump is located at or near the high pressure blow out preventer stack. In some embodiments the subsea pump is adjacent the high pressure blow out preventer stack. More preferably the subsea pump is mounted to the high pressure blow out preventer stack. Typically the subsea pump is mounted to a frame of the high pressure blow out preventer stack.

In some embodiments the choke uses a control system from the low pressure stack. In some embodiments the choke is adapted to use a hydraulic control system from the low pressure stack. In some embodiments the choke is adapted to use a multiplexer control system from the low pressure stack.

In some embodiments the choke is located at or near the high pressure blow out preventer stack. In some embodiments the choke is adjacent the high pressure blow out preventer stack. In some embodiments the choke is mounted to the high pressure blow out preventer stack. Typically the choke is mounted to a frame of the high pressure blow out preventer stack. In some embodiments the choke and kill system comprises multiple chokes. More preferably, the choke and kill system comprises multiple chokes in a single body. In some embodiments the multiple chokes are provided in a redundant arrangement. In some embodiments the low pressure stack includes at least one low pressure blowout preventer.

In some embodiments the high pressure blow out preventer stack comprises at least one high pressure blow out preventer. In some embodiments the high pressure blow out preventer stack comprises a plurality of high pressure blowout preventers. In some embodiments the high pressure blowout preventer stack comprises a wellhead connector to connect to a well. In some embodiments the wellhead connector is located towards a lower end of the high pressure blowout preventer stack. In some embodiments the high pressure blowout preventer stack comprises a mandrel to which the low pressure stack connects to. In some embodiments the mandrel is located towards an upper end of the high pressure blowout preventer stack.

In some embodiments, the choke and kill system comprises multiple redundant sensors to adjust the choke. In some embodiments, the choke and kill system comprises multiple pressure sensors to adjust the choke. In some embodiments, the choke and kill system comprises multiple temperature sensors to adjust the choke.

Low pressure equipment (e.g. low pressure choke line, low pressure kill line, low pressure stack, low pressure blow out preventer) is rated to at most 15,000 psi. Typically, high pressure equipment (e.g. high pressure choke line, high pressure kill line, high pressure blow out preventer, high pressure blow out preventer stack, high pressure pump, high pressure subsea pump) is rated above 15,000 psi. In some embodiments, high pressure equipment is rated to least at 20,000 psi. More preferably, high pressure equipment is rated to at least 25,000 psi.

The disclosure in another aspect relates to a deep water drilling vessel comprising a drilling rig and a choke and kill system as described in this specification. In yet another aspect, the disclosure relates to a method for adapting a low pressure drilling rig for use in a high pressure application, including: connecting a high pressure blowout preventer stack to a low pressure stack of the low pressure drilling rig; fluidly connecting a choke to a low pressure choke line of the low pressure stack; and fluidly connecting the choke to a high pressure choke line of the high pressure blowout preventer stack. The choke is adapted to reduce the pressure from the high pressure choke line to the low pressure choke line.

In some embodiments, the method further includes fluidly connecting a high pressure kill line to the high pressure blowout preventer stack.

In some embodiments fluidly connecting a high pressure kill line to the high pressure blowout preventer stack includes fluidly connecting a low pressure kill line of the low pressure stack to a subsea pump and fluidly connecting the subsea pump to the high pressure kill line, such that the subsea pump can pump fluid from the low pressure kill line to the high pressure kill line, thereby increasing the pressure of the fluid from the low pressure kill line to the high pressure kill line.

Further forms and/or aspects of the present disclosure will become apparent from the following detailed description.

DETAILED DESCRIPTION

Figure 1:
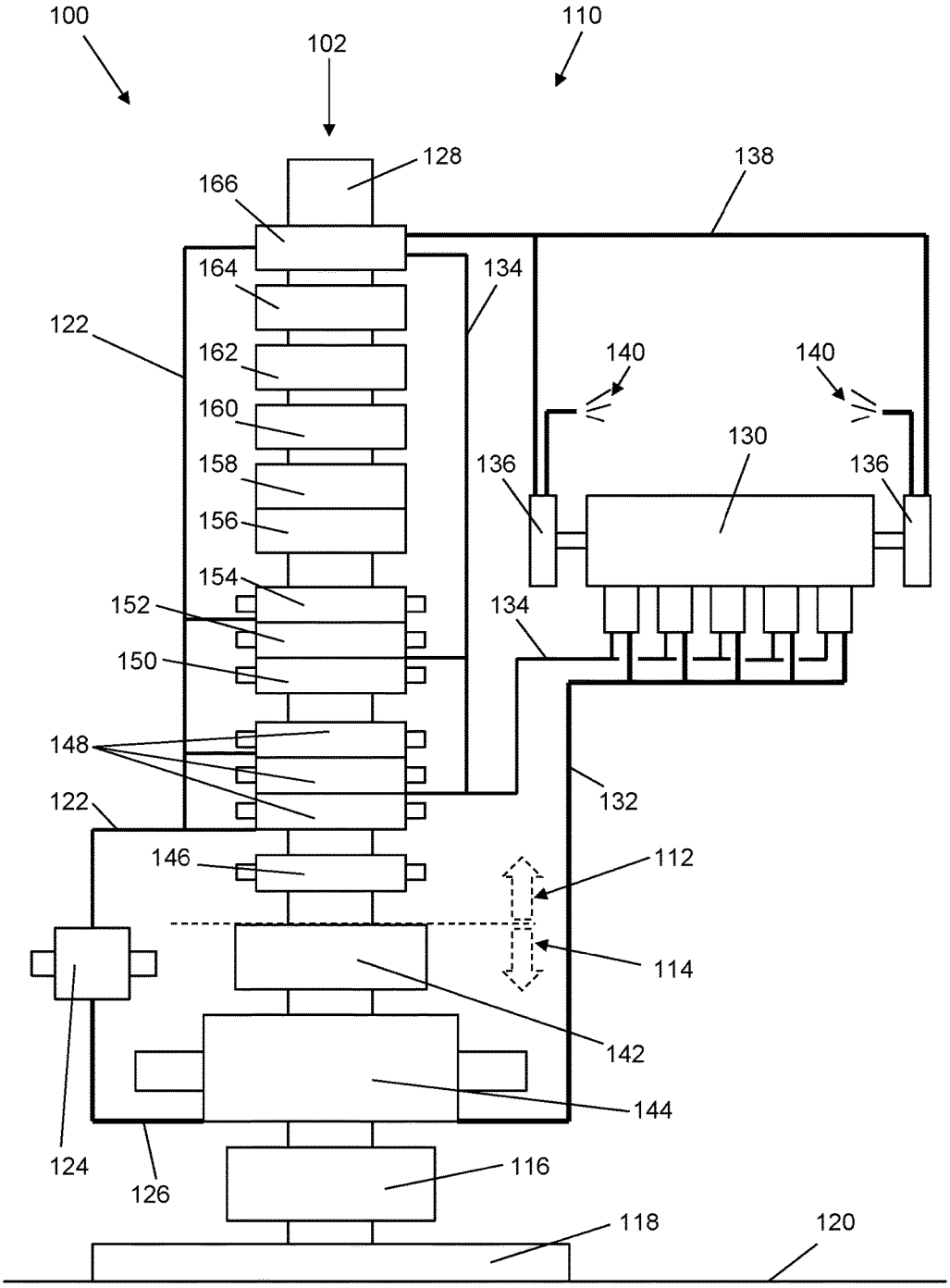
FIG. 1 shows a schematic view of a choke and kill system according to the present invention.

With reference to FIG. 1, there is shown a choke and kill system 100 for a deep water drilling rig 110. The deep water drilling rig 110 has a low pressure stack indicated by dashed arrow 112 and a high pressure blowout preventer stack indicated by dashed arrow 114. In this embodiment, the low pressure stack is rated to at most at 15,000 psi and the high pressure stack is rated to at most 25,000 psi. A person skilled in the art will appreciate that the terms "low" and "high" are relative terms. The low pressure stack 112 in this embodiment is an existing stack to which the high pressure blow out preventer stack 114 has been connected. The high pressure blow out preventer stack 114 has a wellhead connector 116 which connects to a wellhead 118 located on the seafloor 120.

The low pressure stack 112 has a low pressure choke line 122. As the low pressure choke line 122 is rated to at most 15,000 psi, it is not suitable for the high pressure blow out preventer stack 114. To overcome this, the choke and kill system 100 has a choke 124 (rated to at least 25,000 psi) that is fluidly connected to the low pressure choke line 122 and a high pressure choke line 126 (rated to at least 25,000 psi) which in turn is fluidly connected to the high pressure blow out preventer stack 114. In this manner, the choke 124 reduces the pressure from the high pressure choke line 126 to the low pressure choke line 122. The choke 124 comprises multiple chokes (not shown) in a single body. The multiple chokes (not shown) are provided in a redundant arrangement. The choke 124 utilises the control system (not shown) such as a hydraulic control system and/or a multiplexer control system.

The choke and kill system 100 has a subsea pump 130 which can supply fluid in the form of mud or cement to the high pressure blow out preventer stack 114 via a high pressure kill line 132 (rated at 25,000 psi) and into the wellbore 102 in order to stop flow from the wellbore 102 (i.e. kill the high pressure well). Mud is well known in the art and can be for example a drilling fluid.

The subsea pump 130 receives mud from a low pressure kill line 134 (rated at 15,000 psi). In other embodiments (not shown), the subsea pump 130 receives mud from a low pressure auxiliary line.

The subsea pump 130 is driven by radial hydraulic piston motors 136. The radial hydraulic piston motors 136 are driven by seawater which is pumped through a boost line 138. Once the seawater has driven the radial hydraulic piston motors 136, it is discharged to the sea as indicated at 140.

The subsea pump 130 has ceramic bearings (not shown), in this manner, seawater, in which the subsea pump 130 is submerged, can be used to lubricate the ceramic bearings (not shown).

Although the subsea pump 130 is shown separate from the high pressure blow out preventer stack 114 for clarity, it will be appreciated that the subsea pump 130 is typically mounted to a frame (not shown) of the high pressure blow out preventer stack 114.

The high pressure blow out preventer stack 114 has a mandrel 142 to which the low pressure stack 112 connects. The high pressure blow out preventer stack 114 also has a high pressure blow out preventer 144. In another embodiment (not shown) the high pressure blow out preventer stack 114 has two or more high pressure blowout preventers.

The low pressure stack 112 has a subsea stack test ram 146. The low pressure stack 112 has pipe rams 148. The low pressure stack 112 has a casing shear ram 150, a lower blind shear ram 152 and an upper blind shear ram 154. The low pressure stack 112 has an adapter spool 156. A riser connector 158 is attached to the adapter spool 156. The low pressure stack 112 has a lower annular blow out preventer 160 and an upper annular blow out preventer 162. The low pressure stack 112 has a flex joint 164. The low pressure stack 112 has a riser adapter 166. The riser connector 158, the lower annular blow out preventer 160, the upper annular blow out preventer 162, the flex joint 164 and the riser adapter 166 are part of an upper section of the low pressure stack, this upper section may also be referred to as a lower marine riser package. It will be appreciated that in alternate embodiments (not shown), the low pressure stack 112 may have different configurations.

The choke and kill system 100 has multiple redundant sensors (not shown) to monitor upstream and downstream pressure and adjust the choke 124.

Figure 2:
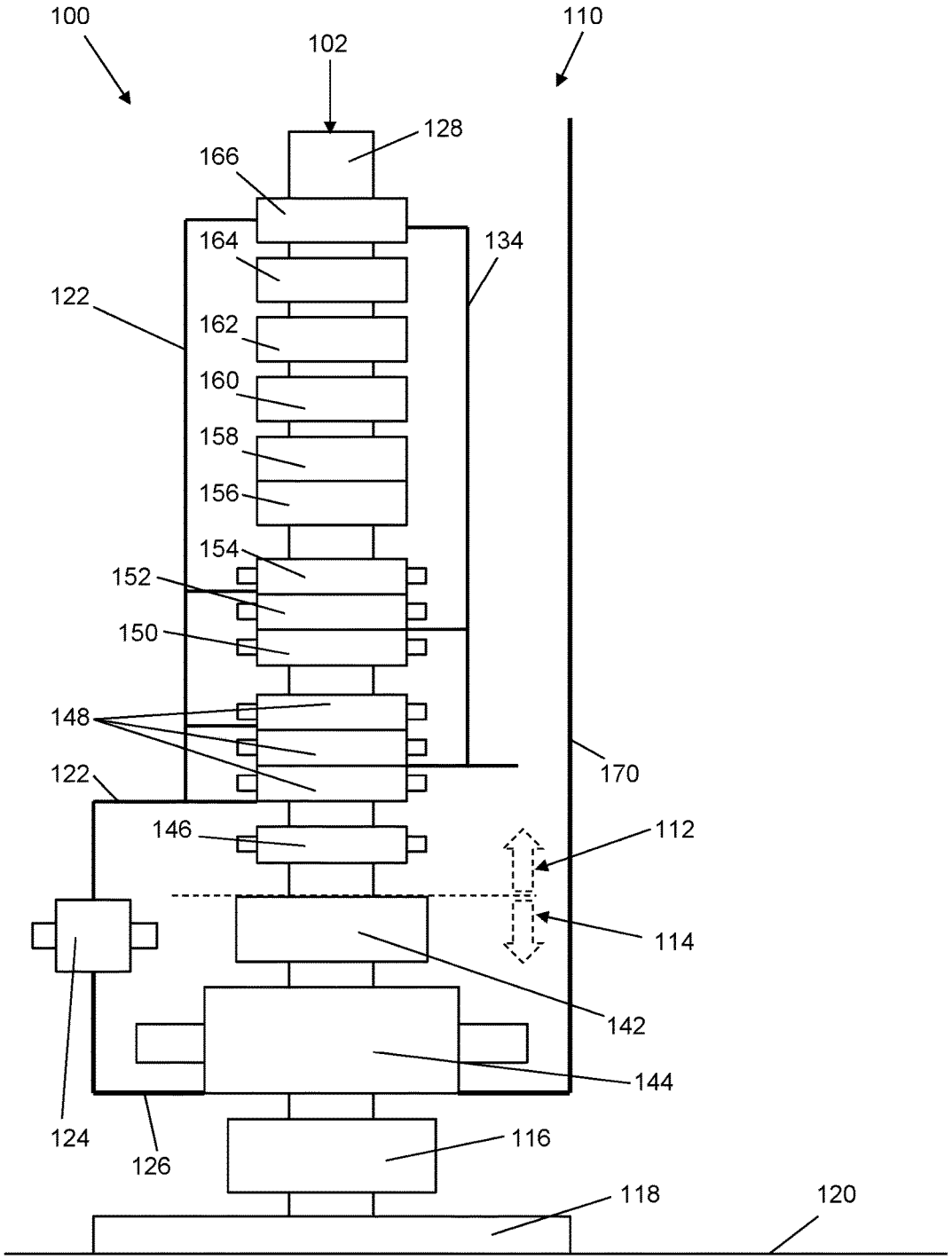
FIG. 2 shows a schematic view of a choke and kill system according to a further embodiment of the present invention.

With reference to FIG. 2, there is shown a choke and kill system 100 for a deep water drilling rig 110 according to a further embodiment of the present invention. FIG. 2 is similar to FIG. 1, the exception being that in the embodiment shown in FIG. 2, there is no subsea pump. Instead, a high pressure kill line 170 (rated at 25,000 psi) extends to a surface vessel (not shown), where a high pressure pump (not shown) is adapted to supply mud to the high pressure kill line 170.

A possible advantage of the present system and method is that high pressure equipment can be used with existing low pressure equipment such as existing low pressure drilling riser, existing low pressure stack, existing low pressure piping and manifolds on a surface vessel, existing blow out preventers on the low pressure stack, and existing surface vessels which are set up for low pressure operation. This can lead to significant savings as the above mentioned low pressure equipment does not need to be replaced by high pressure equipment.

A possible advantage of a further embodiment is that the existing low pressure kill line 134 of an existing low pressure stack 112 can be used when the high pressure blow out preventer stack 114 is connected to the low pressure stack 112.

A possible benefit of using a subsea pump 130 in an embodiment of the present invention is that the boost line 138 of the existing low pressure stack 112 can be used and no return line is required for the "hydraulic fluid" (i.e. seawater) which is vented to the sea.

The foregoing embodiments are illustrative only of the principles of the invention, and various modifications and changes will readily occur to those skilled in the art. The invention is capable of being practiced and carried out in various ways and in other embodiments. For example, individual features from one embodiment may be combined with another embodiment. It is also to be understood that the terminology employed herein is for the purpose of description and should not be regarded as limiting.

In the present specification and claims (if any), the word "comprising" and its derivatives including "comprises" and "comprise" include each of the stated integers but does not exclude the inclusion of one or more further integers unless the context of use indicates otherwise.

Although only a few examples have been described in detail above, those skilled in the art will readily appreciate that many modifications are possible in the examples. Accordingly, all such modifications are intended to be included within the scope of this disclosure as defined in the following claims.

What is claimed is:

1. A choke and kill system for a deep water drilling rig, the choke and kill system comprising:

a low pressure stack of the deep water drilling rig, the low pressure stack comprising pipe rams;

a high pressure blowout preventer stack of the deep water drilling rig fluidly connected to the low pressure stack, the high pressure blowout preventer stack connected to a wellhead, the high pressure blowout preventer stack comprising components rated to a higher pressure than components of the low pressure stack;

a choke fluidly connected to a low pressure choke line of the low pressure stack, the low pressure choke line connected to the low pressure stack below the pipe rams, the choke fluidly connected to a high pressure choke line of the high pressure blowout preventer stack, the high pressure choke line connected below the high pressure blowout preventer stack and above the wellhead, the high pressure choke line rated to a higher pressure than the low pressure choke line, the choke adapted to reduce the pressure from the high pressure choke line to the low pressure choke line.

2. The choke and kill system of claim 1 , further comprising a high pressure kill line fluidly connected to the high pressure blow out preventer stack.

3. The choke and kill system of claim 2, wherein the high pressure kill line is adapted to convey drilling fluid to the high pressure blow out preventer stack.

4. The choke and kill system of claim 3, wherein the high pressure kill line extends to a surface vessel, the surface vessel comprising a pump adapted to supply drilling fluid to the high pressure kill line.

5. The choke and kill system of claim 2, further comprising a subsea pump that is adapted to pump drilling fluid into the high pressure kill line.

6. The choke and kill system of claim 5, wherein the subsea pump is adapted to receive drilling fluid from a low pressure kill line of the drilling riser.

7. The choke and kill system of claim 6, wherein the subsea pump increases the pressure of the drilling fluid from the low pressure kill line to the high pressure kill line.

8. The choke and kill system of claim 5, wherein the subsea pump is adapted to receive drilling fluid from a low pressure auxiliary line of the drilling riser.

9. The choke and kill system of claim 8, wherein the subsea pump increases the pressure of the drilling fluid from the low pressure auxiliary line to the high pressure kill line.

10. The choke and kill system of any one of claim 5, wherein the subsea pump is driven hydraulically.

11. The choke and kill system of claim 10, wherein the subsea pump is driven by at least one radial hydraulic piston motor.

12. The choke and kill system of claim 10, wherein hydraulic fluid to drive the subsea pump is supplied by a riser auxiliary line of the drilling riser.

13. The choke and kill system of claim 12, wherein the hydraulic fluid is seawater.

14. The choke and kill system of claim 12, wherein once the hydraulic fluid has been used to drive the subsea pump, the hydraulic fluid is discharged to the sea.

15. The choke and kill system of claim 5, wherein the subsea pump comprises ceramic bearings.

16. The choke and kill system of claim 5, wherein the subsea pump uses seawater for lubrication.

17. The choke and kill system of claim 15, wherein the subsea pump is located at or near the high pressure blow out preventer stack.

18. The choke and kill system of claim 17, wherein the subsea pump is mounted to the high pressure blow out preventer stack.

19. The choke and kill system of claim 1, wherein the choke uses a control system from the low pressure stack.

20. The choke and kill system of claim 19, wherein the control system is a hydraulic control system.

21. The choke and kill system of claim 19, wherein the choke is adapted to utilise a multiplexer control system from the low pressure stack.

22. The choke and kill system of claim 1, wherein the choke is located proximate the high pressure blow out preventer stack.

23. The choke and kill system of claim 22, wherein the choke is mounted to the high pressure blow out preventer stack.

24. The choke and kill system of claim 1, further comprising a plurality of chokes.

25. The choke and kill system of claim 24, wherein the plurality of chokes is located in a single body.

26. The choke and kill system of claim 1, wherein the low pressure stack includes at least one low pressure blowout preventer.

27. The choke and kill system of claim 1, wherein the high pressure blow out preventer stack comprises a plurality of high pressure blowout preventers.

28. The choke and kill system of claim 27, wherein the high pressure blowout preventer stack comprises a wellhead connector to connect to a well.

29. The choke and kill system of claim 1, wherein the high pressure blowout preventer stack comprises a mandrel located toward an upper end of the high pressure blowout preventer stack to which the low pressure stack connects.

30. The choke and kill system of claim 1, further comprising at least one of pressure and temperature sensors to adjust the choke.

31. The choke and kill system of claim 1, wherein the low pressure stack is rated at at most 15,000 pounds per square inch and the high pressure stack is rated at at least 25,000 pounds per square inch.

32. A method for adapting a low pressure drilling rig for use in a high pressure application, the method comprising:

connecting a high pressure blowout preventer stack to a low pressure stack of the low pressure drilling rig, the high pressure blowout preventer stack connected to a wellhead and rated to a higher pressure than the low pressure stack;

fluidly connecting a choke to a low pressure choke line of the low pressure stack; and fluidly connecting the choke to a high pressure choke line of the high pressure blowout preventer stack, the high pressure choke line connected below the high pressure blowout preventer stack and above a wellhead, the high pressure choke line rated to a higher pressure than the low pressure choke line, wherein the choke is adapted to reduce the pressure from the high pressure choke line to the low pressure choke line.

33. The method of claim 32, further comprising of fluidly connecting a high pressure kill line to the high pressure blowout preventer stack.

34. The method of claim 33, wherein the fluidly connecting the high pressure kill line to the high pressure blowout preventer stack includes fluidly connecting a low pressure kill line of the low pressure stack to a subsea pump and fluidly connecting the subsea pump to the high pressure kill line such that the subsea pump can pump fluid from the low pressure kill line to the high pressure kill line, increasing the pressure of the fluid from the low pressure kill line to the high pressure kill line.

* * * * *